US005267621A

United States Patent [19]

Deken et al.

[11] Patent Number: 5,267,621

[45] Date of Patent: Dec. 7, 1993

[54] DRILL PIPE BREAKOUT DEVICE

[75] Inventors: Arthur D. Deken; Cody L. Sewell, both of Perry, Okla.

[73] Assignee: The Charles Machine Works, Inc., Perry, Okla.

[21] Appl. No.: 968,446

[22] Filed: Oct. 29, 1992

[51] Int. Cl.[5] ..... E21B 23/00

[52] U.S. Cl. ..... 175/57; 175/320

[58] Field of Search ..... 175/57, 320–322; 166/376–381, 77.5

[56] References Cited

U.S. PATENT DOCUMENTS

| | | | |
|---|---|---|---|
| 2,969,702 | 1/1961 | Cornish et al. . | |
| 3,554,298 | 1/1971 | Klein . | |
| 3,768,579 | 10/1973 | Klein . | |
| 3,771,389 | 11/1973 | Coyne . | |
| 3,915,244 | 10/1975 | Brown . | |
| 4,037,672 | 7/1977 | Hodge . | |
| 4,147,215 | 4/1979 | Hodge et al. . | |
| 4,660,634 | 4/1987 | Johnson, Jr. . | |
| 4,691,790 | 9/1987 | Reichman et al. | 175/320 |
| 4,762,187 | 8/1988 | Haney . | |
| 4,830,121 | 5/1989 | Krasnov et al. | 175/57 |
| 5,048,621 | 9/1991 | Bailey et al. | 175/320 X |
| 5,050,691 | 9/1991 | Moses | 175/320 X |

*Primary Examiner*—Thuy M. Bui

*Attorney, Agent, or Firm*—Richards, Medlock & Andrews

[57] ABSTRACT

A drill unit (12) is disclosed which uses slides (18, 20) mounted on the saver-sub (16) of the drill unit to lock the drill pipe (14) to the saver-sub (16) for joint rotation. Dogs (32) are engaged with flats (50) on the drill pipe by moving an outer collar (42) over the end of the drill pipe. The outer collar holds the dogs within the flats to ensure joint rotation between the saver-sub and the drill pipe. The outer collar (42) can be retracted away from the drill pipe to move the dogs out of engagement with the flats and move the slides (18, 20) to the retracted position.

8 Claims, 2 Drawing Sheets

DRILL PIPE BREAKOUT DEVICE

TECHNICAL FIELD OF THE INVENTION

This invention relates to drilling equipment, specifically horizontal boring equipment and in particular to the removal of drill pipe from a drill string.

BACKGROUND OF THE INVENTION

In drilling, it is common to extend the length of the drill string as the drilling proceeds by adding individual threaded drill pipe sections to the drill string. The drilling action of the bit at the end of the drill string is usually accomplished by rotating the entire drill string in one direction continuously. The rotation is induced by a drilling unit at the surface which rotates an output shaft threaded to the last section of pipe in the drill string. Typically, the direction of rotation of the output shaft to drill is the same direction that makes up the threaded connections between the individual sections of pipe and the rotation of the output shaft is therefore efficiently transferred to the drill bit at the cutting face.

When the pipe is to be removed from the drill string after the drilling is completed, the output shaft must be operated in the reverse direction to unthread the individual pipe from the drill string. However, in the absence of external forces, it is difficult to control which of the many threaded connections will be the first broken by this reverse rotation.

To avoid this problem, particularly in the field of horizontal drilling, it is typical to provide a drill unit which has a mechanism to move the output shaft along the machine at least the length of a section of drill pipe. To unthread the uppermost section of pipe from the drill string, the output shaft is retracted so that the uppermost section of pipe is within the drill unit. The end of the next lower pipe is prevented from rotating with a wrench or similar locking method attached to the drill unit. The output shaft is then rotated in the reverse or unthreading direction while an additional person assists the breaking effort with a handheld pipe wrench. This method is relatively fast, but requires two people. Therefore, a need exists for an improved mechanism to assist in breaking out the sections of pipe once the drilling has been completed.

SUMMARY OF THE INVENTION

In accordance with one aspect of the present invention, a mechanism is provided for securing the output shaft of the drill unit to a pipe in a drill string for rotation with the output shaft. An end of the pipe is threaded to the output shaft of the drill unit through a replaceable saver-sub securely attached to the output shaft. The mechanism includes a pair of slides mounted on the saver-sub for rotation therewith. The slides are mounted for sliding movement between a first position spaced from the end of the pipe and a second position extending over the end of the pipe. Each slide has a dog at one end. A slidable outer collar is mounted on the saver-sub for sliding motion between a first position spaced from the end of the pipe and a second position extending over the end of the pipe. As the outer collar moves from the first position to the second position, the outer collar causes the slides to move from the first position to the second position and causes the dogs on the slides to engage flats on the end of the pipe to secure the pipe for rotation with the output shaft.

In accordance with another aspect of the present invention, each of the slides has a camming surface and engaging and retracting stops. As the outer collar moves from the first position to the second position, the outer collar contacts the camming surface of the slides to move the slides to the second position and engages the dogs with the flats on the pipe. The engaging stop on each of the slides limits the movement of the outer collar as it moves from the first to the second positions. As the outer collar is moved from the second position to the first position, the outer collar engages the retracting stops and causes the slides to move from the second position to the first position.

In accordance with another aspect of the present invention, a method is provided for securing a pipe in a drill string for rotation with the output shaft of a drill unit, the end of the pipe being threaded to the saver-sub. The method includes the step of sliding an outer collar from a first position to a second position, the movement of the outer collar between the first and second positions causing a pair of slides mounted on the saver-sub to move from a first position to a second position. The output slides each have a dog thereon which engages a flat on the end of the pipe as the slides are moved to the second position.

In accordance with another aspect of the present invention, the outer collar is mounted on the saver-sub to rotate with the saver-sub. This can be accomplished by using a saver-sub with a square exterior cross-section and an outer collar with a square or rectangular bore which contacts and slides over the exterior of the saver-sub.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 4:
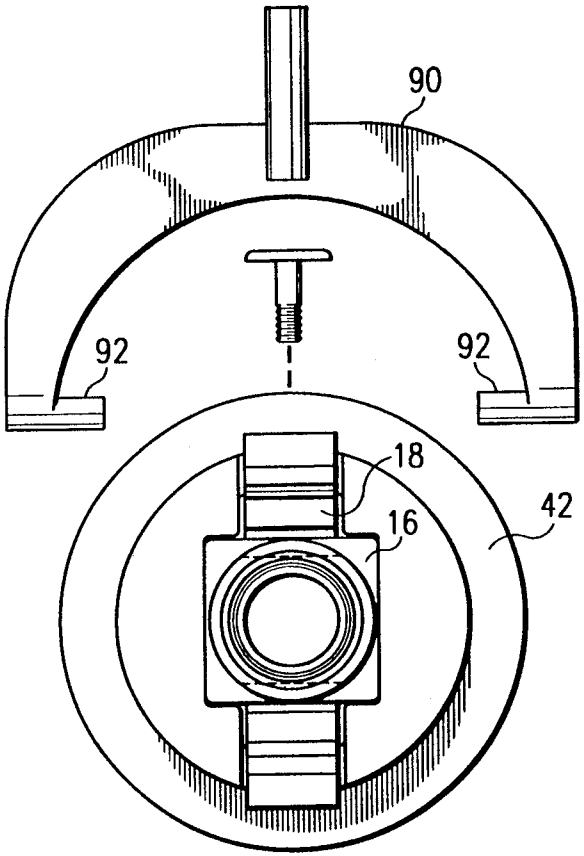
FIG. 4 is a partially exploded end view of the mechanism of FIG. 3.

With reference now to the drawings wherein like reference numerals designate like or similar parts throughout the several views, a mechanism 10 is illustrated which can be used on the saver-sub 16 of a drill unit 12 to assist in removal of the uppermost section of drill pipe 14 in drill string.

As noted previously, a drill unit 12 will have a mechanism, not shown, to rotate an output shaft 13. A saver-sub 16 is attached to the output shaft 13 for rotation with it. The saver-sub is replaceable, and if it wears, only the saver-sub needs to be replaced rather than repairing the whole drill unit. The drill unit rotates the pipe for drilling through the output shaft and saver-sub. The drill motor will be reversible so that the saver-sub 16 can be rotated in a first direction for drilling and making up the threads of the various sections of pipe and in the reverse direction to break out or unthread the threaded connections in the drill pipe.

The saver-sub 16 is mounted on a mechanism within the drill unit 12 which allows the saver-sub 16 to be moved along the direction of the drill string in a manner well known in the industry. As the drilling is ongoing, the saver-sub will rotate in the drilling direction to rotate the drilling bit at the drilling face and the drill unit will advance the drill string into the hole as the drilling continues.

After the drilling has been completed, each individual section of pipe must be removed from the drill string as the drill string is withdrawn from the borehole. In the present invention, the saver-sub 16 is moved to the position within the drill unit so that the wrench mounted on the drill unit can be secured to the upper end of the section of drill pipe to which pipe 14 is secured.

Figure 1:
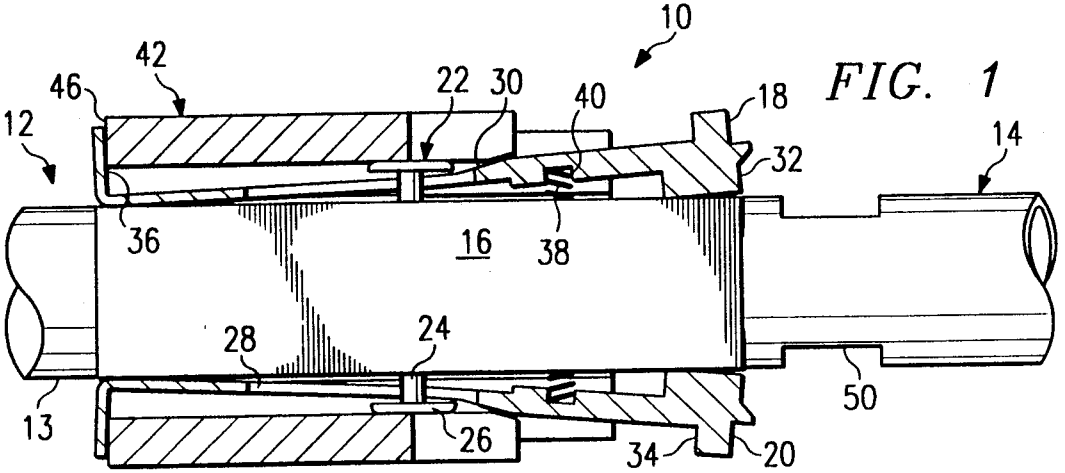
FIG. 1 is a cross-sectional view of a mechanism forming a first embodiment of the present invention in a position without locking a drill pipe.

As seen in FIG. 1, the mechanism 10 includes a pair of slides 18 and 20 mounted on the saver-sub 16. Each shaft is secured to the saver-sub by a single bolt 22 with a small diameter shaft 24 and a large head 26. Each slide is provided with a slot 28 through which shaft 24 passes. The bolt therefore allows the slides to slide along the length of the saver-sub 16 but secures the shafts thereon for rotation with the saver-sub.

The slides are also provided with a camming surface 30, an internally extending dog 32, an engaging stop surface 34 and a retracting stop surface 36. A helical spring 38 is mounted between the outer surface of the saver-sub 16 and a cavity 40 in the dog end of the slide.

Figure 3:
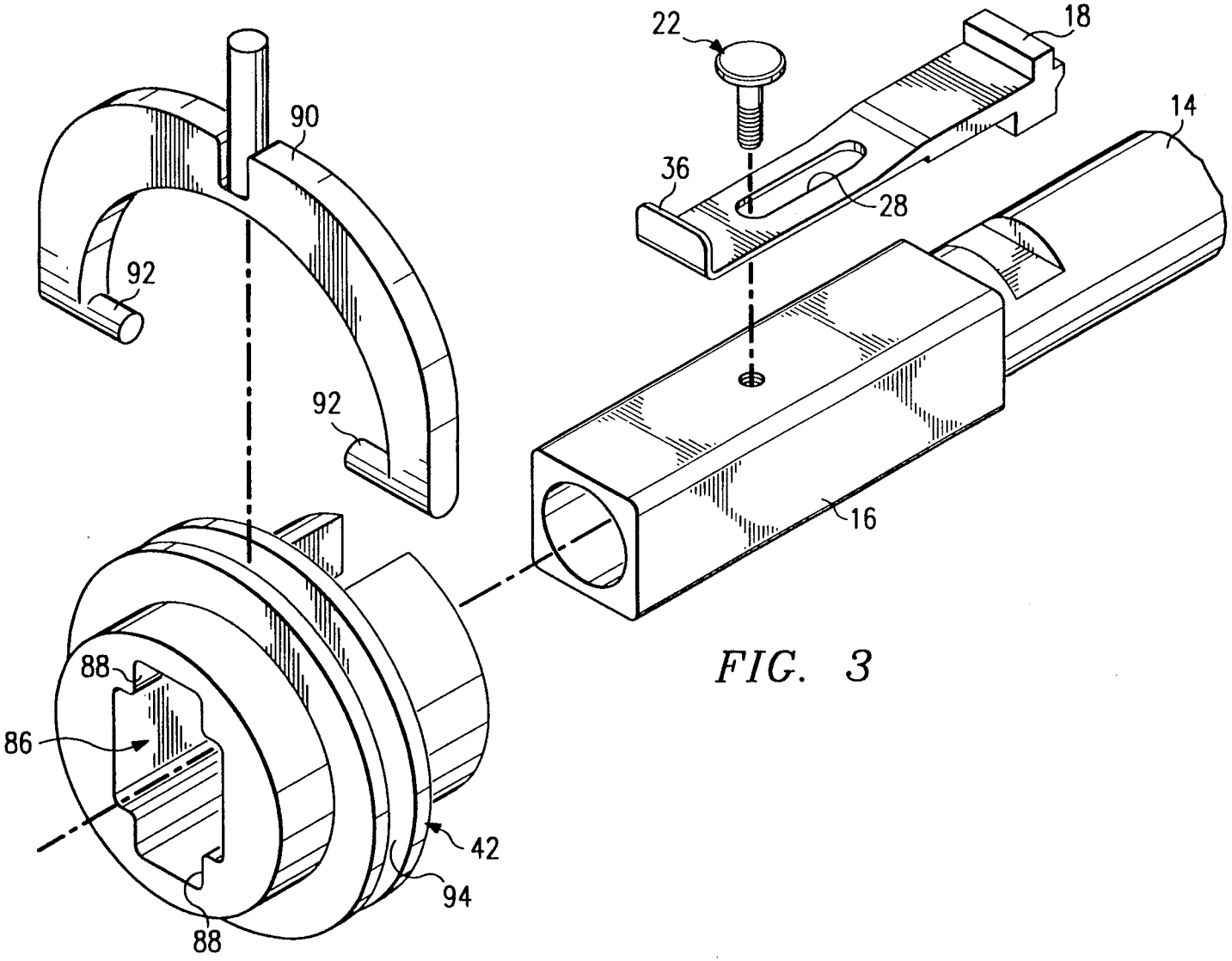
FIG. 3 is a partially exploded perspective view of a the mechanism.

An outer collar 42 is positioned about the saver-sub 16 and over the slides 18 and 20. The outer collar 42 has ends 44 and 46 with end 44 having a camming surface 48. As best seen in FIGS. 3 and 4, the saver-sub 16 can be seen to have a square external cross-section along its entire length. The slides are mounted on opposite faces of the exterior surface of the saver-sub 16. The outer collar 42 can be seen to have a rectangularly configured bore 86 which slides over the saver-sub 16 and permits the collar to slide axially along the saver-sub but ensures that the collar will rotate with the saver-sub. As can be seen, the passage has cutouts 88 so that the slides can move freely relative to the saver-sub.

A shift fork 90 is mounted on the drill unit 12 and is used to shift the outer collar axially along the saver-sub 82. The shift fork can be seen to have tines 92 which are engaged in a groove 94 in the outer collar. With this design, the outer collar can rotate with the saver-sub while the shift fork remains stationary.

In the position shown in FIG. 1, the outer collar 42 has been moved in a direction away from the drill pipe so that the end 46 of the collar engages the retracting stop surface 36 on the slides and causes the slides to be moved away from the drill pipe. In this position, the only connection between the saver-sub 16 and the drill pipe 14 is the threaded connection between them.

Figure 2:
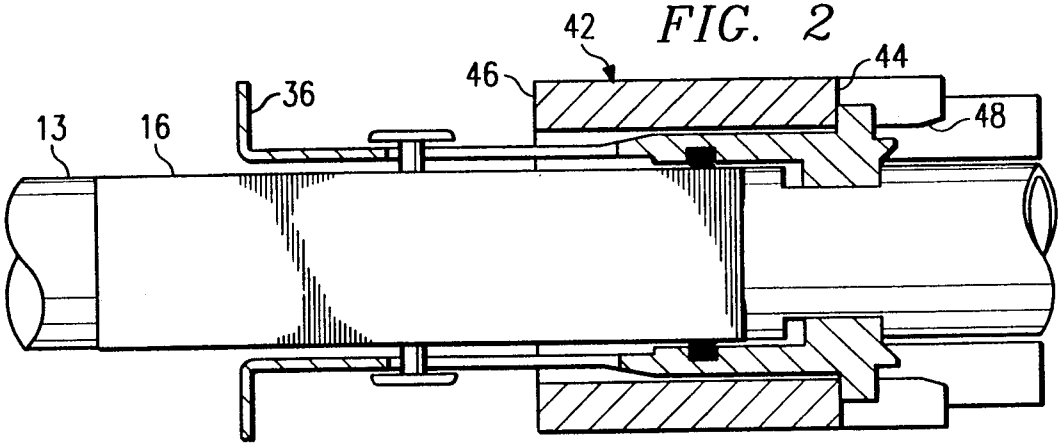
FIG. 2 is a cross-sectional view of the mechanism showing the drill pipe locked to the output shaft.

FIG. 2 illustrates movement of the outer collar 42 toward the drill pipe which, in turn, causes the slides 18 and 20 to be moved toward the drill pipe due to the engagement between the camming surfaces 30 and 48. As the outer collar and slides move toward the position shown in FIG. 2, the dogs 32 will fall into engagement with flats 50 formed in the outer surface of the drill pipe 14 at the end connected to the saver-sub 16. The slides 18 and 20 will be prevented from further motion in this direction as the shaft 24 reaches the end of the slot 28 in the slides. Similarly, further movement of the outer collar 42 will be stopped as the end 44 of the collar engages the engaging stop surface 34 on the slides 18 and 20. In this position, the saver-sub 16 will be positively and mechanically locked to the drill pipe 14 so that both saver-sub 16 and drill pipe 14 will be rotated simultaneously in the direction desired In operation, the drive unit is operated to move the pipe 14 into a position within the drill unit such that a wrench attached to the drill unit can be placed in the flats at the upper end of the pipe adjacent pipe 14. This will prevent the rotation of any part of the drill string other than pipe 14 itself relative to the drill unit. The saver-sub 16 is rotated to break the connection between the drill pipe 14 and the saver-sub 16. This threaded connection will almost always break first rather than the connection between pipe 14 and the adjacent pipe. The mechanism 10 is then extended into the locking position by moving the outer collar 42 in the direction toward the pipe 14. As the camming surfaces 30 and 48 engage each other, the slides are moved forward and the dogs 32 are locked into the flats 50 of the pipe 14 by continuing to slide the outer collar until it rests on stops 34. It should be noted that a slight rotation of the saver-sub may be required to align the slots 50 with the dogs 32.

The mechanism 10 thus has locked the drill pipe 14 for rotation of the saver-sub 16. The saver-sub 16 is then rotated with break the connection between the drill pipe 14 and the adjacent drill pipe in the drill string. It should be noted that the slides will be supported primarily by the walls of cutouts 88 in collar 42 when the saver-sub is rotated to break the threaded connection. Therefore, little or no stress is placed on bolts 22 when rotating the saver-sub to break the connection. The torque force to break the coupling is primarily directed from the square exterior cross-section of saver-sub 16, to the walls of bore 86, from the walls of cutouts 88 to the slides, and from the dogs on the slides to the flats on pipe 14. After unthreading this connection, mechanism 10 is retracted by sliding the collar 42 away from the pipe 14 allowing the unthreading of the joint between the saver-sub 16 and the drill pipe 14. Retraction is accomplished by moving outer collar 42 in a direction away from the drill pipe. The end 46 of the outer collar 42 contacts the retracting stop surface 36 of slides 18 and 20 and moves these slides to the position shown in FIG. 1. The springs 38 apply an outward pressure to the slides to cause the dogs 32 to move out of the flats 50 and clear the outer surface of the saver-sub 16 as the collar 42 is retracted.

It should be noted that various methods may be employed to move the outer collar 42 from position 1 to 2 and back. The moving device can be mounted stationary to the drill unit while the mechanism 10 is rotated with the saver-sub 16.

The use of flats at the upper end of each of the sections of drill pipe provides a positive lock between the mechanism 10 and the sections of pipe and eliminates scarring or marring on the drill pipe and ensures that there will be no slippage once the mechanism and the drill pipe are in engaged. Previous mechanisms which used jaws, chucks or other clamping devices on round pipe causes marking on the pipe and occasionally will slip.

The exterior cross-section of saver-sub 16 and the bore 86 of collar 42 need not have a square/rectangular cross-section. Hexagonal, octagonal, triangular or other suitable cross-sections can be used. It is also important to note that collar 42 need not rotate with saver-sub 16 in the position of FIG. 1. Collar 42 could be designed to allow saver-sub 16 and the slides to rotate while collar 42 is stationary. Then, only when the collar 42 and the slides move into the configuration of FIG. 2, does the collar 42 need to be engaged for rotation with saver-sub 16.

While one embodiment of the present invention has been illustrated in the drawings, and described in the foregoing detailed description, it will be understood that the invention is not limited to the embodiment disclosed, but is capable of numerous rearrangements, modifications and substitutions of parts and elements without departing from the spirit of the invention.

We claim:

1. A mechanism for locking a pipe in a drill string for rotation with the saver-sub of a drill unit, the end of the pipe threaded to the saver-sub, comprising:

a pair of slides mounted on the saver-sub for rotation therewith and axial movement along the saver-sub between a first position spaced from the end of the pipe and a second position extending over the end of the pipe, each slide having a dog formed thereon;

a slidable outer collar mounted on the saver-sub for movement between a first position and a second position, the outer collar engaging the slides as the collar moves to the second position to move the slides to the second position and engage the dogs with flats on the end of the pipe to secure the pipe for rotation with saver-sub.

2. The mechanism of claim 1 where in each of the slides has a engaging stop surface formed thereon, the outer collar moving into engagement with the engaging stop surface when the dogs of the slides engage the flats on the end of the pipe.

3. The mechanism of claim 1 further comprising a spring mounted between the saver-sub and each of the slides to move the dogs out of the flats as the outer collar and slides are moved from the second position to the first position.

4. The mechanism of claim 1 wherein each of the slides has a retracting stop surface, movement of the outer collar from the second position to the first position causing the outer collar to move into engagement with the retracting stop surfaces and thereby move the slides from the second position to the first position.

5. The mechanism of claim 1 wherein the pair of slides and the outer collar rotates with the saver-sub of the drill unit.

6. The mechanism of claim 1 wherein the slides each define a elongated slot therethrough extending in the direction parallel to the axis of rotation of the saver-sub, a bolt passing through the slot in each of the slides to attach the slides to the saver-sub.

7. A method for securing a pipe for rotation with the saver-sub of a drill unit, the end of the pipe threaded to the saver-sub, comprising the steps of:

moving a slidable outer collar between a first position and a second position, the outer collar moving a pair of slides mounted on the saver-sub for rotation therewith from a first position to a second position, each slide having a dog which engages a flat in the end of the pipe as the slides are moved into the second position to secure the pipe for rotation with the saver-sub.

8. The method of claim 7 further comprising the step of moving the outer collar from the second position to the first position, the outer collar contacting the pair of slides to move the slides from the second position to the first position to move the dogs out of engagement with the flats in the end of the pipe.

* * * * *